US009908251B2

(12) United States Patent
Kuchina et al.

(10) Patent No.: US 9,908,251 B2
(45) Date of Patent: Mar. 6, 2018

(54) METHOD OF CUTTING TUBULAR MEMBERS AND APPARATUS THEREFOR

(71) Applicant: FEDERAL-MOGUL POWERTRAIN, INC., Southfield, MI (US)

(72) Inventors: Takahiro Kuchina, Ashigarakami-Gun (JP); Tsubasa Tonooka, Sagamihara (JP)

(73) Assignee: Federal-Mogul Powertrain LLC, Southfield, MI (US)

( * ) Notice: Subject to any disclaimer, the term of this patent is extended or adjusted under 35 U.S.C. 154(b) by 0 days.

(21) Appl. No.: 15/096,561

(22) Filed: Apr. 12, 2016

(65) Prior Publication Data

US 2016/0221205 A1 Aug. 4, 2016

Related U.S. Application Data

(62) Division of application No. 13/645,097, filed on Oct. 4, 2012, now Pat. No. 9,333,662.

(51) Int. Cl.

| | |
|---|---|
| ***B26D 3/16*** | (2006.01) |
| ***B26D 5/08*** | (2006.01) |
| ***B26D 1/46*** | (2006.01) |
| ***B26F 3/08*** | (2006.01) |
| ***B26F 3/12*** | (2006.01) |
| ***B26D 7/10*** | (2006.01) |

(52) U.S. Cl.

CPC ..... *B26D 3/16* (2013.01); *B26D 1/46* (2013.01); *B26D 5/08* (2013.01); *B26D 7/10* (2013.01); *B26F 3/08* (2013.01); *B26F 3/12* (2013.01); *Y10T 83/0596* (2015.04); *Y10T 83/293* (2015.04); *Y10T 83/869* (2015.04)

(58) Field of Classification Search

CPC ... B26D 5/08; B26D 1/46; B26D 7/10; B26D 3/16; B26F 3/08; B26F 3/12; Y10T 83/869; Y10T 83/0596; Y10T 83/293

USPC ..... 83/16, 171, 523, 54

See application file for complete search history.

(56) References Cited

U.S. PATENT DOCUMENTS

| | | | | | |
|---|---|---|---|---|---|
| 2,438,156 | A | * | 3/1948 | Dodge | B26F 3/12 15/179 |
| 4,369,686 | A | * | 1/1983 | Sugimoto | B23D 53/04 83/746 |
| 4,478,120 | A | * | 10/1984 | Sugimoto | B23D 55/088 83/644 |
| 4,487,097 | A | * | 12/1984 | Hara | B23D 53/04 83/56 |
| 4,766,790 | A | * | 8/1988 | Harris | B23D 53/08 83/56 |
| 5,005,289 | A | * | 4/1991 | Vogele | B26F 3/12 30/140 |

(Continued)

*Primary Examiner* — Omar Flores Sanchez

(74) *Attorney, Agent, or Firm* — Robert L. Stearns; Dickinson Wright, PLLC

(57) ABSTRACT

A method of cutting a polymeric tubular member and apparatus therefor is provided. The method includes moving the polymeric tubular member along a central longitudinal axis into a position to be cut. Further, providing at least one actuator with a cutting blade operably connected to the at least one actuator, with the cutting blade extending lengthwise along a cutting blade axis. Then, actuating the at least one actuator and moving the cutting blade into cutting engagement with the polymeric tubular member along a driven axis that extends in oblique relation to the cutting blade axis.

9 Claims, 5 Drawing Sheets

(56) References Cited

U.S. PATENT DOCUMENTS

| | | | | | |
|---|---|---|---|---|---|
| 5,081,890 | A | * | 1/1992 | Stolzer | B23D 53/045 83/13 |
| 5,213,022 | A | * | 5/1993 | Elgan | B23D 53/04 83/797 |
| 5,320,016 | A | * | 6/1994 | Spath | B23D 53/04 83/794 |
| 5,347,903 | A | * | 9/1994 | Stolzer | B23D 53/04 83/796 |

* cited by examiner

METHOD OF CUTTING TUBULAR MEMBERS AND APPARATUS THEREFOR

CROSS REFERENCE TO RELATED APPLICATIONS

This U.S. divisional application claims the benefit of U.S. utility patent application Ser. No. 13/645,097, filed Oct. 4, 2012, the entire content of which is incorporated herein by reference in its entirety.

BACKGROUND OF THE INVENTION

1. Technical Field

This invention relates generally to methods and apparatus for cutting tubular members, and more particularly to methods and apparatus for cutting polymeric tubular members, such as textile polymeric sleeves.

2. Related Art

Polymeric tubular members, such as textile polymeric tubular members, are known to be cut widthwise to a predetermined length, as desired. As shown in FIGS. 1A and 1B, a textile tubular sleeve 1 containing polymeric yarn, is commonly fed lengthwise in a direction 2 parallel to a central longitudinal axis 3 until a desire length L to be cut extends beyond a cutting blade 4. Then, the cutting blade 4, which is oriented to extend along its longitudinal axis 5 such that a leading cutting edge 6 is perpendicular to the central longitudinal axis 3, is moved along a straight linear path 7 perpendicular to the central longitudinal axis 3 and longitudinal axis 5. The cutting blade 4 can further be heated, which is known to facilitate making a clean cut through the polymeric yarn of the sleeve 1. Given the relative orientations of the sleeve 1, the blade 4, and their respective directions 2, 7 of movement, as shown in FIG. 1B, a region 8 of the blade 4 that cuts through the sleeve 1 is limited to a width 8 of the blade 4 corresponding to a diameter D of the sleeve 1, such that W=D. As such, although the blade 4 may initially perform clean cuts, generally free of end fray, over extended use during a cutting operation, the cutting edge 6 in the region 8 becomes dull and the heat generated within the region 8 becomes cooled. This results due to the relatively narrow region 8 being used to perform the cutting over a repeated cutting cycle. Further yet, as can be seen in FIG. 1B, with the orientation of the cutting edge 6 being as shown and described, the cutting edge 6 makes initial cutting contact with a leading apex A1 of the tubular sleeve 1 and progresses through the full width of the sleeve 1 until it exits lastly the trailing apex A2 of the sleeve 1. Accordingly, the cutting motion of the cutting edge 6 is one of pure compression. The dulling, cooling, and pure compressive cutting motion of the cutting blade 4 all result in a less than desirable cut, particularly when combined with one another. Accordingly, it typically becomes necessary to slow the cutting process to a less than optimal rate, and further requires changing the cutting blade 4 frequently, and in many cases, 2 or 3 times over an 8 hour shift.

SUMMARY OF THE INVENTION

In accordance with one aspect of the invention, a method of cutting a polymeric tubular member is provided. The method includes moving the polymeric tubular member along a central longitudinal axis into a position to be cut. Further, providing at least one actuator with a cutting blade operably connected to the at least one actuator, with the cutting blade extending lengthwise along a cutting blade axis. Then, actuating the at least one actuator and moving the cutting blade into cutting engagement with the polymeric tubular member along a driven axis that extends in oblique relation to the cutting blade axis.

In accordance with a further aspect of the invention, the method includes orienting the driven axis in substantially perpendicular relation to the central longitudinal axis.

In accordance with a further aspect of the invention, the method includes bringing a cutting region of the cutting blade into cutting engagement with the polymeric tubular member, the cutting region extending over a length of the cutting blade that is greater than a diameter of the polymeric tubular member.

In accordance with a further aspect of the invention, the method includes providing the at least one actuator as a plurality of actuators.

In accordance with a further aspect of the invention, the method includes configuring the plurality of actuators in operable communication with one another.

In accordance with a further aspect of the invention, the method includes driving a first one of the actuators at a linear speed relative to the linear speed of a second one of the actuators.

In accordance with a further aspect of the invention, the method includes configuring the first one of the actuators to drive along a first direction and the second one of the actuators to drive along a second direction substantially perpendicular to the first direction.

In accordance with a further aspect of the invention, the method includes heating the cutting blade prior to cutting the polymeric tubular member and substantially maintaining the temperature of the heated cutting blade while cutting the polymeric tubular member.

In accordance with a further aspect of the invention, the method includes providing the polymeric tubular member as a textile sleeve.

In accordance with a further aspect of the invention, an apparatus for cutting a polymeric tubular member is provided. The apparatus includes at least one actuator and a cutting blade operably connected to the at least one actuator. The cutting blade extends lengthwise along a cutting blade axis. Further, the at least one actuator is configured to move the cutting blade into cutting engagement with the polymeric tubular member along a driven axis that extends in oblique relation to the cutting blade axis.

In accordance with a further aspect of the invention, the driven axis of the apparatus is substantially perpendicular to the central longitudinal axis.

In accordance with a further aspect of the invention, the at least one actuator includes a plurality of actuators.

In accordance with a further aspect of the invention, the plurality of actuators are in operable communication with one another.

In accordance with a further aspect of the invention, a first one of the plurality of actuators drives at a linear speed relative to a linear speed of a second one of the plurality of actuators.

In accordance with a further aspect of the invention, a first one of the plurality of actuators drives along a first direction and a second one of said plurality of actuators drives along a second direction substantially perpendicular to the first direction.

BRIEF DESCRIPTION OF THE DRAWINGS

These and other aspects, features and advantages of the present invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1A:
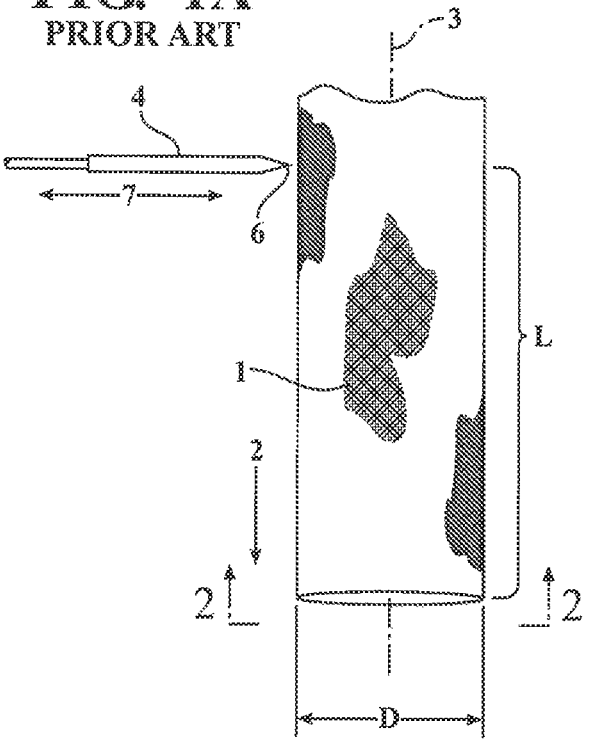
FIG. 1A PRIOR ART
FIG. 1A is a schematic side view of an apparatus for cutting a polymeric tubular member in accordance with the prior art.
Figure 1B:
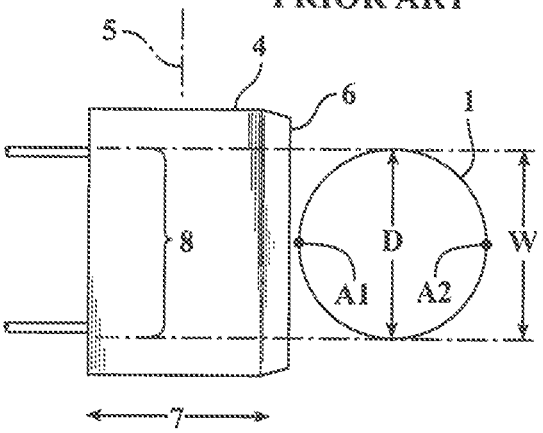
FIG. 1B PRIOR ART
FIG. 1B is a schematic plan view taken generally along line 1B-1B of FIG. 1A.
Figure 2:
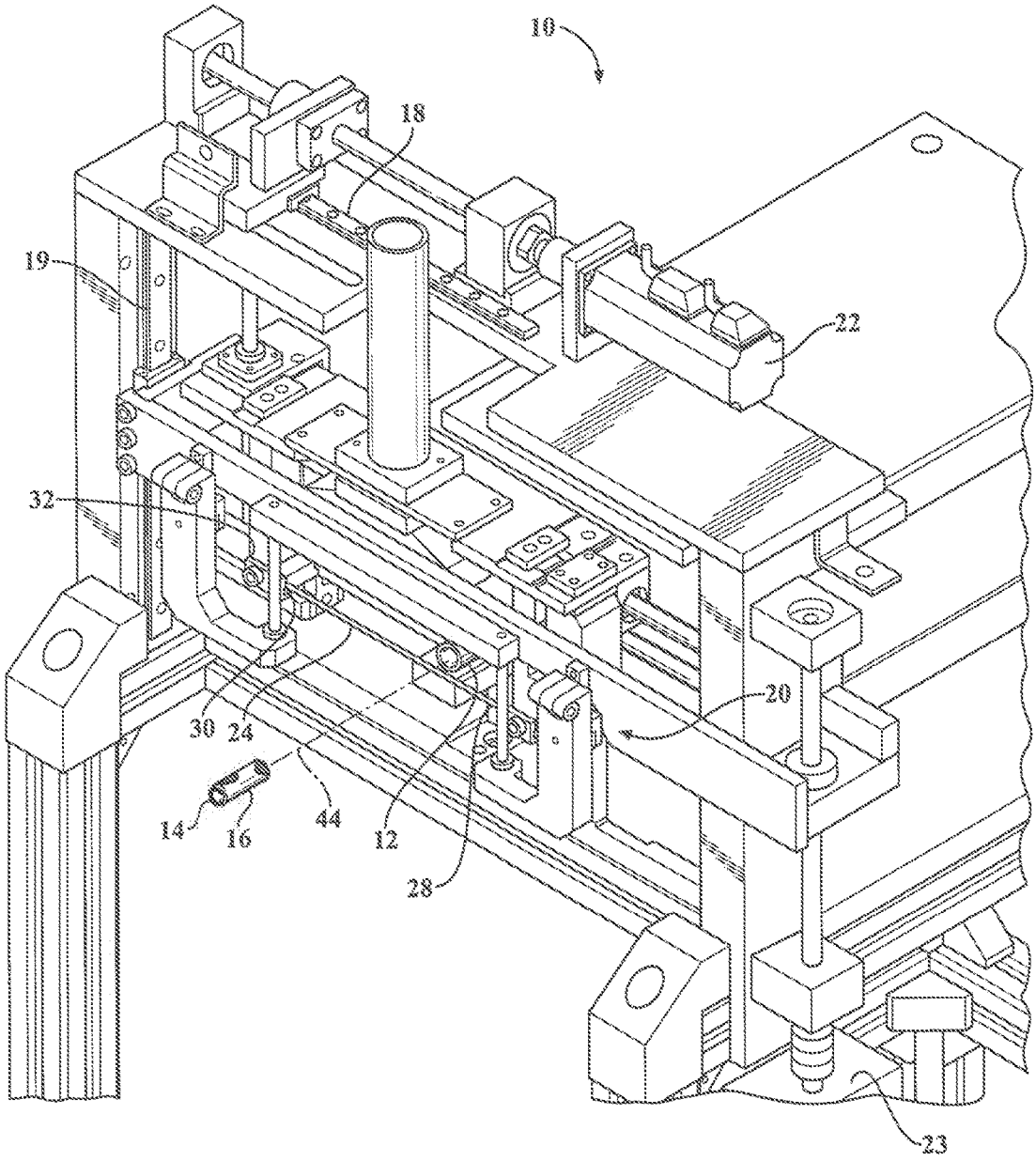
FIG. 2 is a perspective view of an apparatus for cutting a polymeric tubular member in accordance with one aspect of the invention.

Referring in more detail to the drawings, FIG. 2 illustrates a cutting apparatus, referred to hereafter as apparatus 10, for cutting a polymeric tubular member, such as a tubular textile sleeve 12 (FIGS. 3A-3C) containing polymeric yarn, in accordance with one aspect of the invention. The apparatus 10 cuts the sleeve 12 in a quick and efficient manner, such that the ends 14 of the sleeve 12 are cut cleanly, thereby being free of end fray. Accordingly, the sleeve 12 takes on a pleasing aesthetic appearance and exhibits a long and useful life, with greatly diminished chance of becoming damaged due to end fray. Further, the sleeve 12 is economical in manufacture, thereby resulting increased rates of production without jeopardizing the quality of the end product, as well as reducing the need for service of the apparatus 10.

Figure 3A:
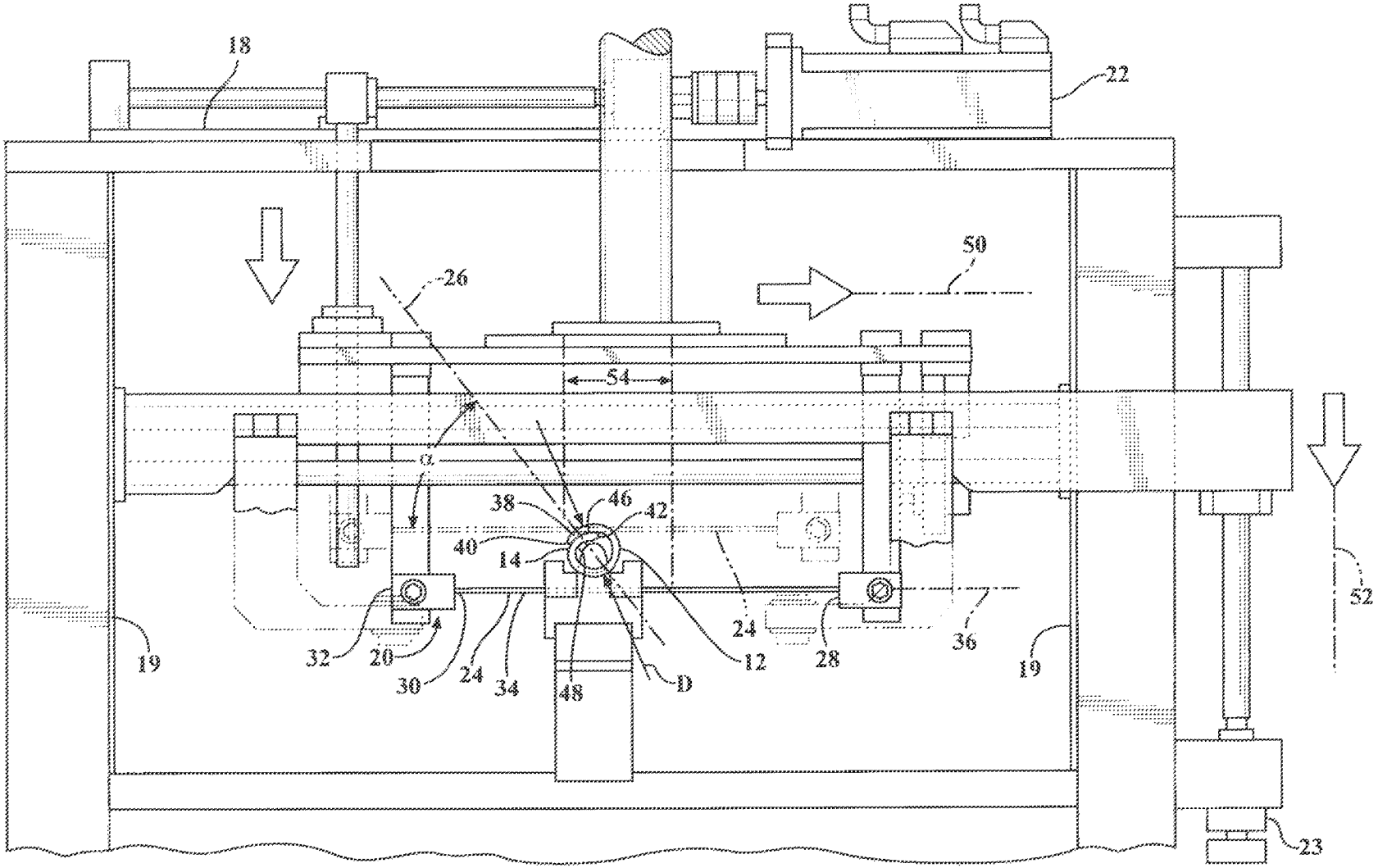
FIGS. 3A-3C are sequential schematic plan views of a cutting blade of the apparatus of FIG. 2 in various cutting positions as the cutting blade is cutting through the polymeric tubular member.
Figure 3B:
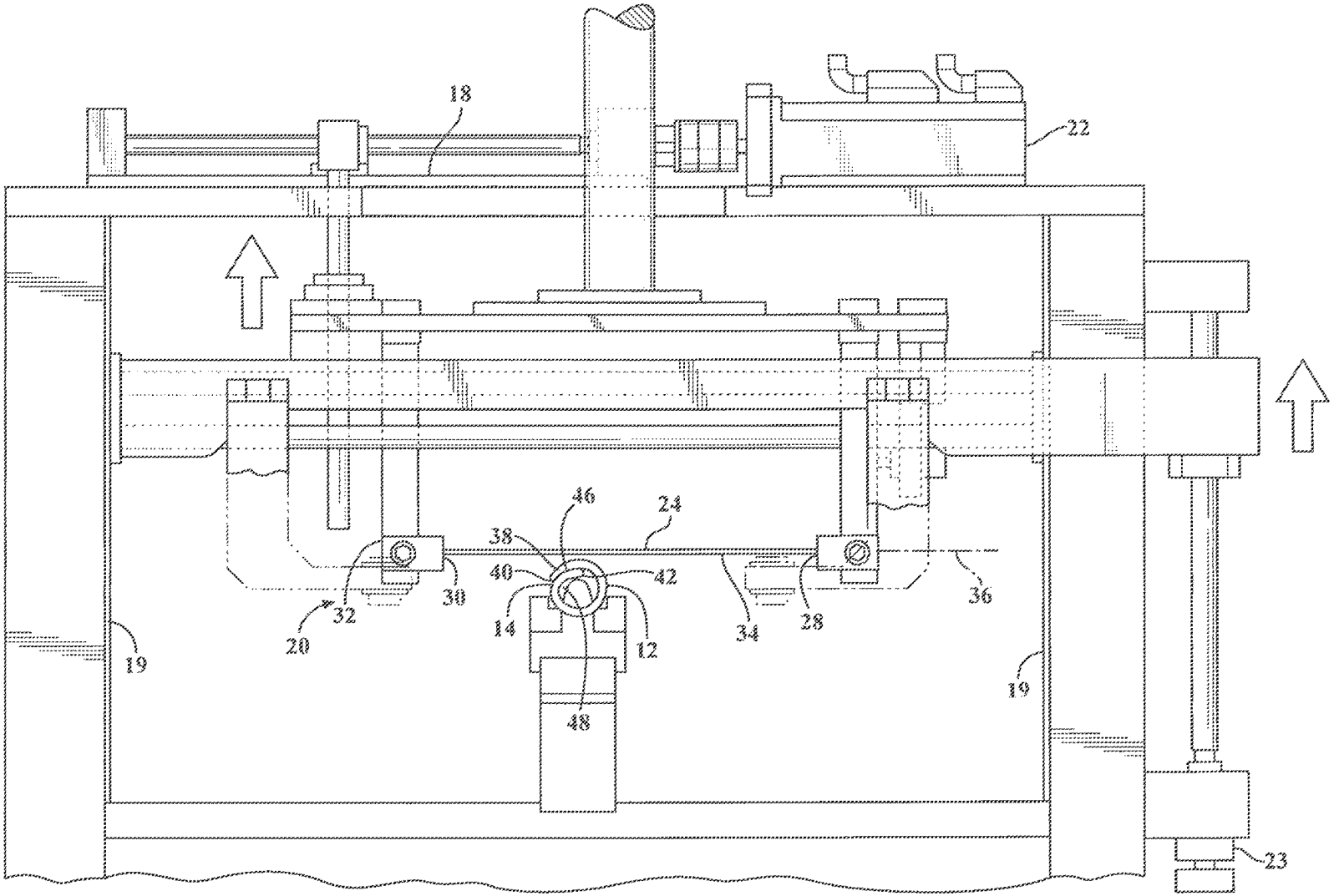
Figure 3C:
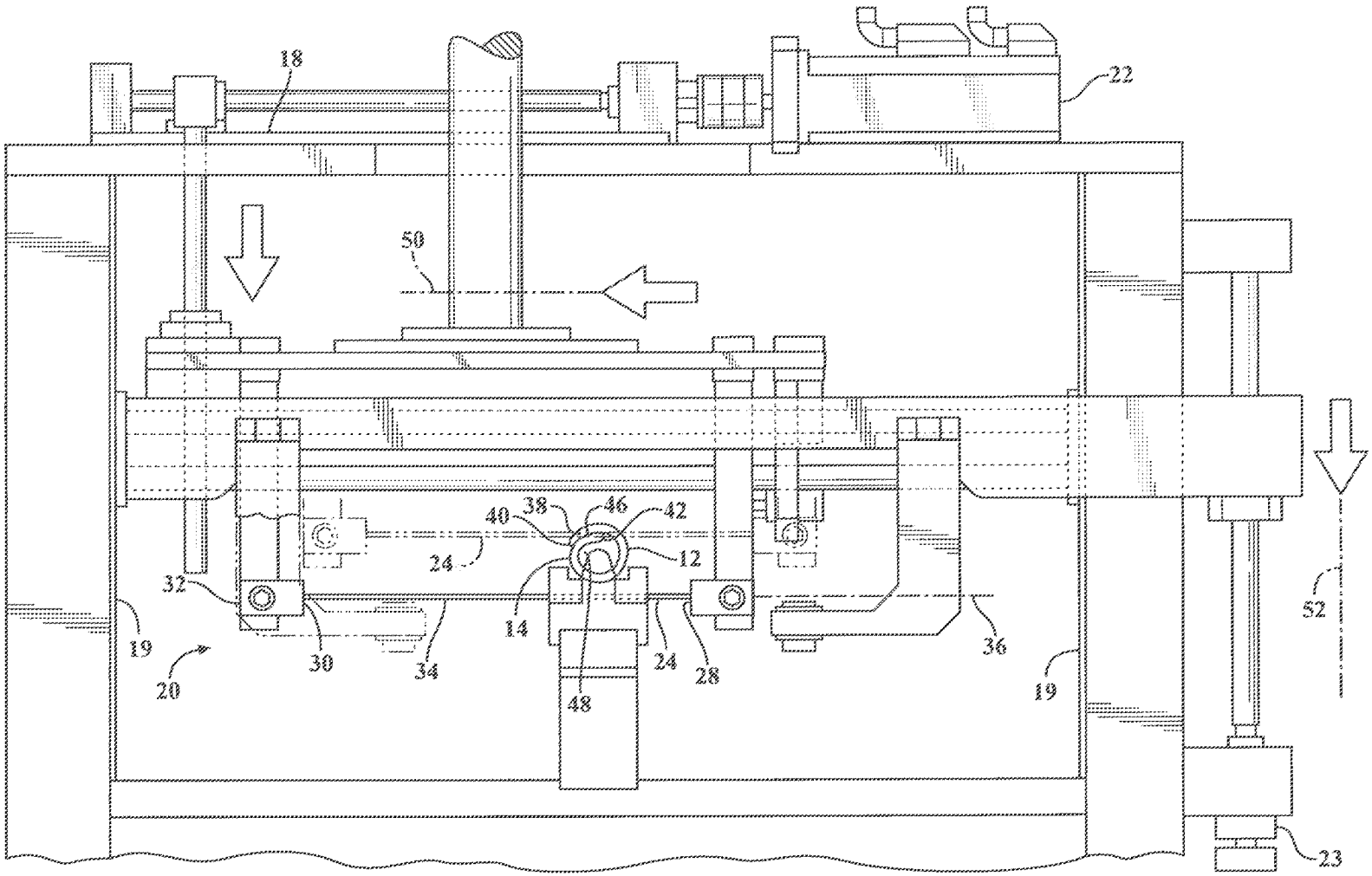

The apparatus 10 includes a pair of straight linear slide rails 18, 19 along which a cutting assembly 20 traverses. To advance the cutting assembly 20 along the slide rails 18, 19, at least one, and shown as a plurality of actuators 22, 23 are operably connected to the cutting assembly 10. The actuators 22, 23 can be provided as any suitable linear actuator, including, but not limited to, screw-type actuators, hydraulic actuators, pneumatic actuators, solenoid-type actuators, and the like, as are known in the art of linear motion. The actuators 22, 23 and cutting assembly 20 are shown in FIG. 3B in a fully retracted, non-cutting position, and in FIGS. 3A and 3C is a cutting progression with a cutting blade 24, sometimes referred to as cutting wire, being advanced along a driven axis, also referred to as cutting axis 26, through the sleeve 12 to cut the length of sleeve 12 desired.

The cutting blade 24 is fixed adjacent its opposite ends 28, 30 to a cutting blade carrier, also referred to as support member 32, of the cutting assembly 20. The support member 32 is operably attached to the actuators 22, 23 for conjoint movement therewith along the slide rails 18, 19 and along the cutting axis 26. The cutting blade 24 has a leading cutting edge 34 that extends along a longitudinal cutting blade axis 36 of the cutting blade 24 that is oblique to the cutting axis 26. The angle of oblique inclination $\alpha$ is controlled by adjusting the relative movement of the actuators 22, 23, discussed further hereafter. To facilitate cutting through the polymeric material of the sleeve 12, and to promote forming a clean, end fray free cut, the cutting blade is heated via a suitable connection to a source of electricity (not shown).

The textile sleeve 12 has a wall 38 that can be constructed having any suitable size, including length (determined by the cutting process), diameter and wall thickness. The wall 38, shown as an open wall construction, has opposite edges 40, 42 extending generally parallel to a central longitudinal axis 44 of the sleeve 12 that terminate at the open opposite ends 14, 16. When the wall 38 is in its self-wrapped tubular configuration, generally free from any externally applied forces, the edges 40, 42 can overlap one another at least slightly to form a seam 46 and fully enclose a central cavity 48 circumferentially, and thus, the wall 38 provides enhanced protection to the elongate members, such as a wire harness (not shown), contained in the cavity 48 upon installation of the sleeve 10 in use. The edges 40, 42 are readily extendable away from one another under an externally applied force to at least partially open and expose the cavity 48. Accordingly, the elongate member can be readily disposed into the cavity 48 during assembly or removed from the cavity 48 during service. Upon releasing the externally applied force, the edges 40, 42 return automatically under a bias imparted from being heat set to their relaxed, overlapping self-wrapped position.

The wall 38 can be constructed from multifilament and/or monofilament yarns, with at least one or more of the yarns being provided as a heat-settable polymeric yarn. For example, one or more of the yarns can be provided as a heat-settable polymeric material, such as polyphenylene sulfide (PPS), for example, which can be heat set at a temperature of about 200-225 degrees Celsius. The wall 38 can be woven, knit, or braided, from the yarn, as desired.

During the cutting operation, the material of the wall 38, having already been heat-set into its self-wrapping configuration, is fed along its central longitudinal axis 44 so that a predetermined length (this is the finish length of the sleeve 10 upon being cut to length) of the wall 38 extends beyond the cutting blade 24, while the cutting blade is in its fully retracted position (FIG. 3B). Then, the support member 38, with the heated cutting blade 24 fixed thereto, is advance along the cutting axis 26 via actuation of the actuators 22, 23, at least in part simultaneously with one another, to perform the cutting. The actuators 22, 23, referred to as first actuator 22 and second actuator 23, are respectively configured to move the cutting blade 24 along first and second axes 50, 52 that are both perpendicular to one another and also to the central longitudinal axis 44 of the sleeve 12. Accordingly, the three axes 50, 52, 44 correspond, respectively, to X, Y, Z axes of a three dimensional Cartesian coordinate system. With the first actuator 22 advancing the cutting blade 24 along the X-axis and the second actuator 23 simultaneously advancing the cutting blade 24 along the Y-axis, the cutting blade 24 is advance along the cutting axis 26 that is a resultant angle of oblique inclination $\alpha$ to both the X and Y axes 50, 52 and the cutting blade axis 36. One of ordinary skill in the art will readily recognize that the resultant angle $\alpha$ of the cutting axis 26 is determined thus, by the relative speed of travel of the cutting blade 24 along the respective X and Y axes 50, 52. If the travel speed is the same along each axis X, Y, then the cutting axis 26 will be at an oblique 45 degree angle $\alpha$ relative the respective X and Y axes 50, 52. However, if the rate of travel is greater along the X-axis 50 than the Y-axis 52, then the relative oblique angle of inclination $\alpha$ will be less than 45 degrees relative to the X-axis 50 and greater than 45 degrees relative to the Y-axis 52. Conversely, if the rate of travel is greater along the Y-axis 52 than the X-axis 50, then the relative angle of inclination $\alpha$ will be less than 45 degrees relative to the Y-axis 52 and greater than 45 degrees relative to the X-axis 50. Accordingly, the oblique angle $\alpha$ of the cutting axis 26 relative to the X and Y axes 50, 52 can be precisely controlled, as desired, by driving the actuators 22, 23 at predetermined linear speeds relative to one another.

With the axis 26 of the cutting blade 24 being fixed in perpendicular relation to the central longitudinal axis 44, an active cutting region 54 of the cutting blade 24 is brought into cutting engagement with the tubular sleeve wall 38, wherein the cutting region 54 extends over an axial length of the cutting blade 24 that is greater than a diameter D of the tubular wall 38. Accordingly, the axial length of the cutting blade 24 that is responsible for cutting the wall 38 to length is greater than the diameter D of the wall. This allows an increased axial length of the cutting blade 24 and cutting edge 34 to be used during each cutting cycle, which in turn allows the cutting edge 34 to retain its sharpness for an increased number of cutting cycles, and further, it allows the cutting blade 24 to maintain an elevated, constant or substantially constant temperature throughout each cutting cycle, thereby maximizing the ability to perform a clean, end fray free cut. Then, upon being cut to length, a new cutting cycle is performed.

The length of the cutting region 54 is ultimately determined by the angle of inclination $\alpha$ relative to the cutting blade axis 36 and X and Y-axes 50, 52. For example, the smaller the angle of inclination $\alpha$ relative to the X-axis 50, the greater the axial length of the cutting region 54. By way of example, where the angle of inclination $\alpha$ is 30 degrees relative to the X-axis 50, the axial length of the cutting region 54 is 2 times the diameter D of the wall 38. Accordingly, in contrast to the prior art, wherein only an axial length of cutting blade equal to the diameter D of the wall is used, twice as much, or more, of the cutting blade can now be used, thereby making the apparatus and method of cutting therewith economical and efficient.

Many modifications and variations of the present invention are possible in light of the above teachings. It is, therefore, to he understood that the invention may be practiced otherwise than as specifically described, and that the scope of the invention is defined by any ultimately allowed claims.

What is claimed is:

1. An apparatus for cutting a polymeric tubular member, comprising:

at least one actuator;

a cutting blade carrier operably attached to said at least one actuator;

a cutting blade having opposite ends fixed to said cutting blade carrier, said cutting blade having a leading cutting edge that extends lengthwise along a cutting blade axis between said opposite ends, said cutting blade being configured to be operably heated; and said at least one actuator being configured to move said leading cutting edge of said cutting blade into cutting engagement with the polymeric tubular member and to drive said cutting blade carrier and said cutting blade simultaneously along first and second axes, with the first axis extending parallel to the cutting blade axis and the second axis extending perpendicular to the first axis, such that the cutting blade is driven in oblique relation to said cutting blade axis without tilting said leading cutting edge during movement of said cutting blade along said driven axis through the polymeric tubular member.

2. The apparatus of claim 1 wherein said driven axis is substantially perpendicular to said central longitudinal axis.

3. The apparatus of claim 1 wherein said at least one actuator includes a plurality of actuators.

4. The apparatus of claim 3 wherein said plurality of actuators are in operable communication with one another.

5. The apparatus of claim 4 wherein a first one of said plurality of actuators drives at a linear speed relative to a linear speed of a second one of said plurality of actuators.

6. The apparatus of claim 3 further including configuring a first one of said plurality of actuators to drive along a first direction and a second one of said plurality of actuators to drive along a second direction substantially perpendicular to said first direction.

7. The apparatus of claim 1 wherein said cutting blade is a wire.

8. An apparatus for cutting a polymeric tubular member, comprising:

at least one actuator;

a support member operably attached to said at least one actuator;

a wire extending lengthwise between opposite ends and being configured to be heated, said opposite ends being fixed to said support member; and said at least one actuator being configured to move said wire into cutting engagement with the polymeric tubular member and to drive said wire and said support member simultaneously along first and second axes, with the first axis extending parallel to the length of said wire and the second axis extending perpendicular to the first axis, such that said wire is driven along a resultant axis extending between said first and second axes.

9. The apparatus of claim 8 wherein said result axis is straight.

* * * * *